United States Patent [19]

Karg

[11] Patent Number: 4,778,117

[45] Date of Patent: Oct. 18, 1988

[54] DEVICE FOR CHOPPING UP GARDEN WASTE

[75] Inventor: Erwin Karg, Neusäss, Fed. Rep. of Germany

[73] Assignee: Lescha Maschinenfabrik GmbH, Fed. Rep. of Germany

[21] Appl. No.: 60,610

[22] Filed: Jun. 11, 1987

[30] Foreign Application Priority Data

Jun. 26, 1986 [DE] Fed. Rep. of Germany ..... 3621418

[51] Int. Cl.[4] ..... B02C 18/12

[52] U.S. Cl. ..... 241/92; 241/101.7; 241/282.2

[58] Field of Search ..... 241/92, 101.7, 282.1, 241/282.2

[56] References Cited

U.S. PATENT DOCUMENTS 4,593,863 6/1986 Mordstein et al. ..... 241/101.7 X
4,595,148 6/1986 Luerken et al. ..... 241/101.7 X

FOREIGN PATENT DOCUMENTS 3232504 3/1984 Fed. Rep. of Germany ... 241/101.7
3324274 5/1987 Fed. Rep. of Germany .

OTHER PUBLICATIONS

European Patent Application, 0175313, 3-86.

*Primary Examiner*—Mark Rosenbaum
*Attorney, Agent, or Firm*—Jones, Tullar & Cooper

[57] ABSTRACT

In the context of a device for chopping up garden waste or the like of the type comprising a housing mounted on support legs and having at least one ejector opening, a preferably vertical charging passage mounted on the housing, a carrier disk adapted to rotate in the housing about an upright axis and mounted on the shaft of a motor attached to the housing so that the disk shuts off the housing at a lower end thereof and at least one generally radially aligned knife on the disk which is placed on a trailing edge, i.e. the edge which is to the rear in the direction of rotation, of a slot in the disk, the knife being arranged to cooperate with a stationary support bolster in the form of a circumferential part, extending transversely in relation to the direction of rotation, of the charging passage under which the knife moves, the invention seeks to achieve an improved functional performance and a compact construction insofar as in at least a lower part thereof the charging passage has a cross section which extends from the edge part of the carrying disk towards its center provided with a deflector mounted thereon and which is provided with at least one circumferential inward protrusion, whose trailing side respectively forms a stationary support bolster for supporting the waste being chopped, and furthermore the motor is carried on the floor part, overlapped by the carrier disk, of a housing chamber, which at its circumference has a number of ejection openings equal to the number of inward protrusions, whose axis is in a projection generally perpendicular to the projection of the side, which forms the respective associated stationary support bolster, of the corresponding circumferential inward protrusion of the charging chamber.

19 Claims, 3 Drawing Sheets

DEVICE FOR CHOPPING UP GARDEN WASTE

BACKGROUND OF THE INVENTION

The invention relates to a device for chopping up garden waste or the like of the type comprising a housing mounted on support legs and having at least one ejector opening, a preferably vertical charging passage mounted on the housing, a carrier disk adapted to rotate in the housing about an upright axis and mounted on the shaft of a motor attached to the housing so that the disk shuts off the housing at a lower end thereof and at least one generally radially aligned knife on the disk which is placed on the trailing edge, i. e. the edge which is to the rear in the direction of rotation, of a slot in the disk. The knife is arranged to cooperate with a stationary support bolster in the form of a circumferential part, extending transversely in relation to the direction of rotation, of the charging passage under which the knife moves.

An apparatus having these features has been described in German Pat. No. 3,324,274. In this known device the motor is arranged on top of the housing. The charging passage, which is also mounted at the top, accordingly is located radially outside the centrally placed motor and has a kidney-shaped cross section. Arrangements of this type have to have a large overall size if they are to ensure a large enough inlet cross section of the charging passage. If the arrangement is designed with a smaller overall size and with a correspondingly reduced inlet cross section of the charging passage, its cross section would however be too small and the consequence of this would be increased likelihood of stoppages, more especially when chopping up flabby leaf material etc. The known design principle is therefore not applicable to small choppers, for which however there is a considerable demand.

SUMMARY OF THE INVENTION

Taking this prior art as a starting point, one object of the present invention is to devise an apparatus of the type in question which has a simple and cheaply produced design so as to represent an improvement on previous apparatus.

A further aim of the invention is to provide such an apparatus which while being of comparatively small overall size has a large inlet cross section at the end of the charging passage.

A still further purpose of the invention is to provide such an apparatus which is capable of operating smoothly and without stoppages.

In order to achieve these or other objects appearing in the course of the ensuing specification and claims, in at least a lower part thereof the charging passage has a cross section which extends from the edge part of the carrying disk towards its center provided with a deflector mounted thereon and which is provided with at least one circumferential inward protrusion, whose trailing side respectively forms a stationary support bolster for supporting the waste being chopped, and furthermore the motor is carried on the floor part, overlapped by the carrier disk, of a housing chamber, which at its circumference has a number of ejection openings equal to the number of inward protrusions, whose axis is in a projection generally perpendicular to the projection of the side, which forms the respective associated stationary support bolster, of the corresponding circumferential inward protrusion of the charging shaft.

Owing to the fact that the motor is now located under the carrier disk and the latter is horizontally aligned, practically the full area of the carrier disk is exposed to the inlet cross section of the charging passage. There is then the advantage that the latter may extend past the center of the disk, that is to say include it as well, so that the result is a comparatively large cross section of the charging passage. The deflector member mounted on the center of the carrier disk within the charging passage then ensures that there is no dead space. A further advantage of the invention is to be seen in the fact that owing to the design of the stationary support bolster in accordance with the invention, the charging passage remains in the form of a circumferential inward protrusion on the passage side without any further internal structures. It is thus possible for the charging passage to have a constant cross section along its full length, this being a further advantage inasfar as manufacture is then substantially simplified. The invention thus leads to the advantage of a compact overall design without this involving any disadvantageous consequences as regards functional reliability and operation free from stoppages.

In accordance with one further development of the invention the charging passage may be made up of two half shells joined together along their longitudinal edges. This further feature of the invention makes it possible to use simple pressings for the construction of the charging passage.

As a further feature of the invention each side, forming a stationary support bolster, of the charging passage is such that its radially outer end is inclined in relation to a radius perpendicular to the axis of ejection against the direction of rotation while its inner radial end is inclined in the direction of rotation. This means that if the knife is radial or approximately so there will be a scissors cut starting at a radially outer point. The material to be chopped up is thus automatically drawn inwards. A further advantage is that this feature ensures a satisfactory direction of ejection for the chopped material at the outer knife end and also for that adjacent to the inner end thereof.

In accordance with the invention, in the case of the provision of one inward protrusion, the charging passage may have a cross section corresponding to a segment of a circle concentric to the axis of the carrier disk and a chord bent radially inwards halfway between its ends. This makes possible a more or less full utilisation of the available area of the carrier disk and thus also a comparatively large cross section of the charging passage even if the apparatus has a very small overall size.

In accordance with a further development of the invention the charging passage may have a polygonal cross section centered on the axis of the disk with at least one, and more especially two, inward protrusions at 180° to each other, the housing correspondingly having a corresponding number of ejection openings. The result is then a number of cutting sites, corresponding to the number of inward protrusions and each having an associated ejection opening. It is then possible to distribute the material in the process of being chopped up over a number of ejection openings, something which is advantageous as regards preventing stoppages.

It is possible for each knife to have its inner edge resting against the deflector member, whose maximum diameter is equal to twice the distance of the radially inner edge of the inward protrusion or inward protrusions, as the case may be, from the axis of the carrier disk. This leads to a very dependable chopping action exerted on the material hurled out by the deflector member.

In keeping with a further development of the invention it is possible for the deflector member to be in the form of a shape with at least one circumferential spur projecting into the charging passage and with a central hole, through which there extends a screw connecting the carrier disk with the motor shaft. This leads to a simple attachment of the deflector member, which owing to the cross section extending beyond the center of the carrier disk of the charging passage may then project into the charging passage, this leading to a particularly satisfactory deflecting effect. Furthermore, the deflector member may be in the form of a spur-bearing shape so that the weight is uniformly balanced about the axis.

In accordance with a further feature of the invention it is an advantage if the carrier disk is provided with only one, preferably radially aligned knife. This knife and the slot associated therewith may extend as far as the center of the carrier disk without decreasing the strength of the disk. This leads to a very compact form of the deflector member. At the same time this feature makes possible the use of a motor with a particularly small size and thus to a construction which is generally light and inexpensive.

The design may be one having two parallel knives offset forwards in the direction of rotation in relation to a diametral line. In this case the two knives and the slots associated therewith may be made shorter than in a design with one knife. The length of the stationary support bolster is correspondingly shortened. This further feature of the invention is thus more particularly to be used in conjunction with an apparatus with a polygonal cross section of the charging passage having two inward protrusions forming a respective stationary support bolster, since in such a design the comparatively short knife length means that even the narrowest cross section of the polygonal charging passage may be comparatively large.

The ejection opening, which preferably has a passage area which is directed obliquely downwards, may have a downwardly inclined ejection passage mounted thereon. This makes it possible on the one hand to direct the ejected stream of material as desired and on the other hand provides access to the carrier disk provided with knives.

Further features and developments of the invention will be seen from the following detailed account of some working examples with reference to the drawings.

DETAILED DESCRIPTION OF THE PREFERRED EMBODIMENTS OF THE INVENTION

Figure 1:
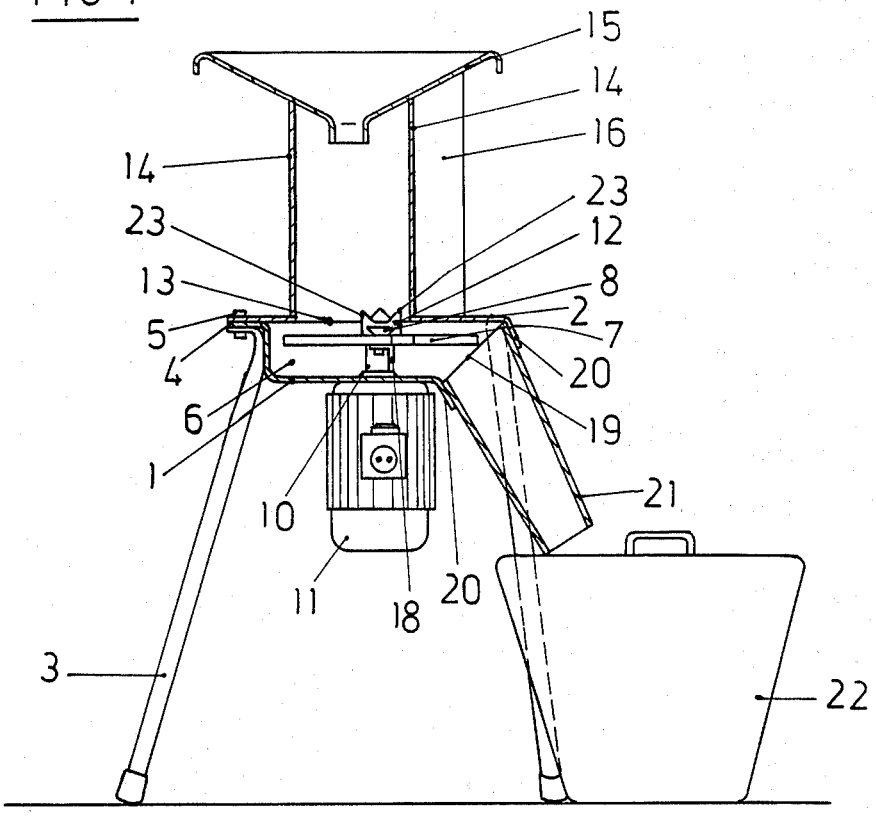
FIG. 1 is a longitudinal upright section taken through a first embodiment of the garden waste chopper of the invention having one ejector opening and one knife.
Figure 2:
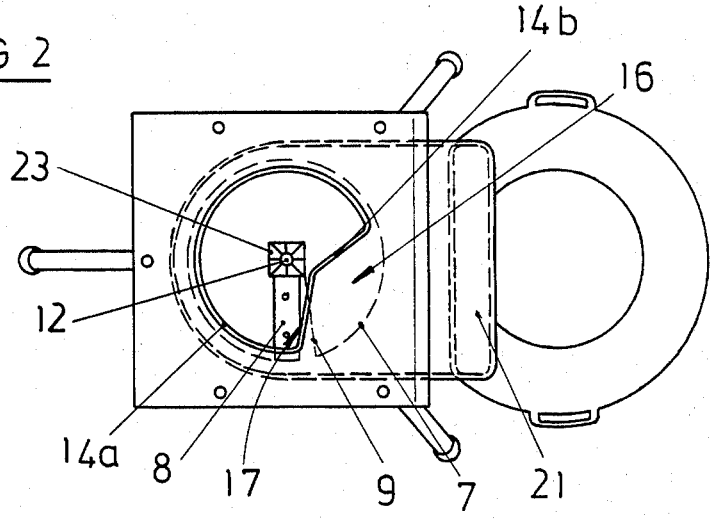
FIG. 2 is a plan view of the arrangement of FIG. 1 after removal of the hopper.
Figure 5:
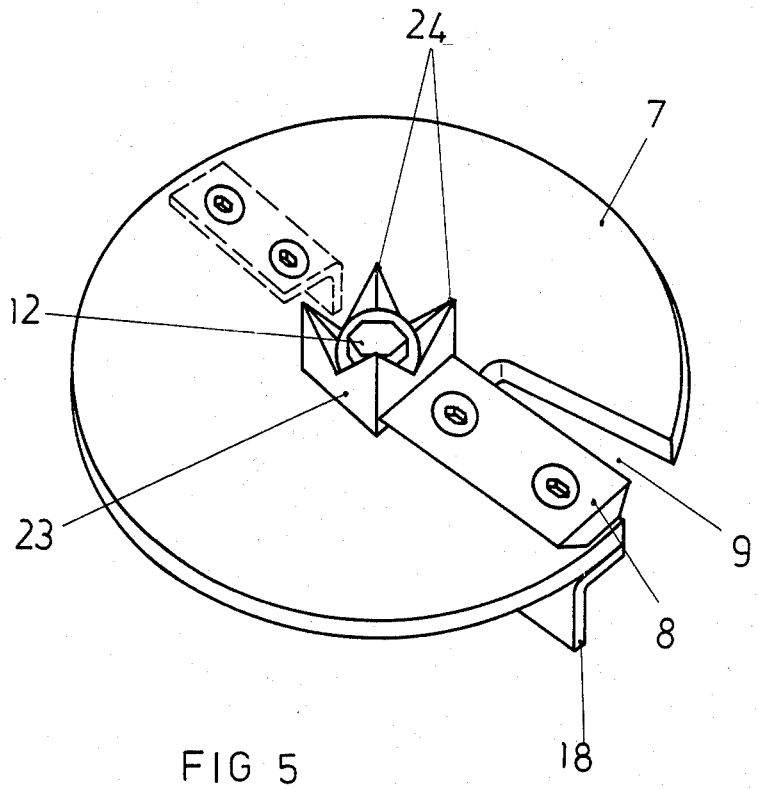
FIG. 5 is a view on a larger scale of a preferred working example of the deflector member mounted on the carrier disk and used in both embodiments of the invention.

The garden waste chopper shown in FIGS. 1 and 2 is made with a housing consisting of a shell-like floor 1 with a flange-mounted cover 2. The housing is supported on three upright legs 3 whose upper ends are fitted to the flange 4 of the lower housing part by means of flange joining bolts 5. The housing consisting of the floor 1 with the cover 2 flanged thereon defines a chamber 6 in which a carrier disk 7 armed with a knife 8 is arranged which is attached by screws to the carrier disk 7 in such a way that it overlaps (see also FIG. 5) the trailing edge (that is to say the rear edge in the direction of rotation) of an appropriate slot 9 in the carrier disk. The carrier disk 7 is fitted with its axis upright on a shaft 10, also having a vertical axis and placed under the disk 7, of a motor 11 mounted on the outer face of the floor 1. The motor is in the present case an electric one. The carrier disk may in this respect be centered by a suitable adapter on the motor shaft fitting into a central hole and be attached by a retaining screw 12 on the shaft 10, the screw being received in a tapped blind hole in the adapter.

The cover 2 is provided with a charging opening 13 over the carrier disk 7 in which the lower end of a charging passage 14 is mounted, the opening having the same cross section as this end. In the illustrated working example the tubular charging passage 14 has a constant cross section along its whole length and is arranged so that its axis is perpendicular to the plane of the carrier disk 7. A hopper 15 is mounted on the upper end of the charging passage 14 in order to prevent direct access to the carrier disk 7. The charging opening 13 and accordingly the charging passage 14 as well have a cross section which extends from the edge part of the carrier disk 7 over its center, that is to say including the center of the carrier disk 7 so that the cross section is almost as large as the area of the carrier disk. This area of the carrier disk 7 is generally effective to shut off the charging passage 14 to a substantial extent, as will best be seen from FIG. 2.

In order to form a stationary support bolster for cooperating with the knife 8 arranged on the rotating carrier disk 7 for the material thrown into the charging passage, the supply opening 13 and the charging passage 14 are provided with a radial circumferential inward protrusion 16 against whose trailing side (the side on the rear as related to the direction of rotation) the material to be chopped is shoved due to the rotary motion of the carrier disk 7. The charging passage 14 is arranged so that its axis is upright: it may be in the form of a tubular element. In the illustrated working example the charging passage 14 is made up of two half-shells 14*a* and 14*b*, respectively, as will best be seen from FIG. 2, of which one half-shell 14*a* has a semi-circular configuration and the other half-shell 14*b* has a generally V-like cross section to form the inward protrusion 16. The two shells 14*a* and 14*b* are joined together along their longitudinal edges, for example by welding. The result is then more or less a cross section of the passage in the form of a circular section extending past a semicircle with a chord bent inwards radially in order to form the inward protrusion 16 in the center. The charging passage 14 is so mounted on the cover 2 of the housing as will best be seen from FIG. 2 that the center of curvature of the semi-circular shell-half is on the axis of the carrier disk 7. The depth of the inward protrusion 16 is in this respect so selected that a stationary support bolster 17 so formed has a radial extent at least equal to the length of the knife 8 cooperating therewith. The rear side of the inward protrusion 16 forming the stationary support bolster 17 may be radial in relation to the disk axis. In the illustrated working example the rear side, forming the support bolster 17, of the inward protrusion 16 is inclined by 3° to 5° in relation to a radius so that the radially inner end of the support bolster 17 is inclined in the direction of rotation of the carrier disk 7 and the radially outer end is inclined away from against the direction of rotation. This results in a scissors cutting action proceeding in a radially inward direction if the knife is generally radially aligned, such a scissors cutting effect being an advantage as regards an even loading of the motor. At the same time there is an effective ejecting action along the full length of the knife.

The chopped material passes downwards through the slot 9 and is slung out by vanes 18 arranged on the lower side of the carrier disk 7 via an ejection opening 19 in the housing associated with the stationary support bolster. The ejection opening 19 is in this respect so arranged that as seen in plan view there is no bend in the ejection path. To ensure that this is so a perpendicular to the area of the ejection opening 19 is generally perpendicular to the side of the inward protrusion 16 which is to the rear in the direction of rotation and forms the stationary support bolster 17. The ejection opening 19 is formed by a cutout, arranged so that its area is inclined, in the trough-like floor 1. In the part adjacent to the ejection opening 19 the floor 1 and the cover 2 placed thereover may be provided with a sheet metal guide plate causing the material to be deflected downwards. In the illustrated working example of the invention the floor 1 and the cover 2 are provided with edge ears 20 delimiting the ejection opening 19, on which an ejection passage 21 is so attached that its axis is inclined obliquely downwards. This ejection passage 21 serves to guide the stream of ejected material into a receptacle of the type indicated at 22.

In order to avoid the presence of dead space adjacent to the center of the carrier disk 7 the latter has a centrally located deflector member 23 mounted thereon. The latter may be simply secured in place by the bolt 12 and for this purpose is provided with a central hole. The deflector member 23 may be in the form of an L-like or U-like rib. In the illustrated working example of the invention the deflector member 23 is in the form of a spur-bearing shape with a number of spurs 24 on its circumference, as will best be seen from FIG. 5. These spurs ensure a vigorous stirring action at the center of the carrier disk so that material fed into the charging passage 14 is reliably and systematically flung radially outwards into the path of the knife 8. The knife 8, which in the present cage is arranged radially, has its radially inner edge engaging an adjacent side of the deflector member 23. The depth of the inward protrusion 16 is such that the maximum diameter of the deflector member 23 is equal to twice the distance of the inner bent edge from the center of the carrier disk 7 so that the material will be systematically and fully chopped up once as it has been thrown into the charging passage 14.

Figure 3:
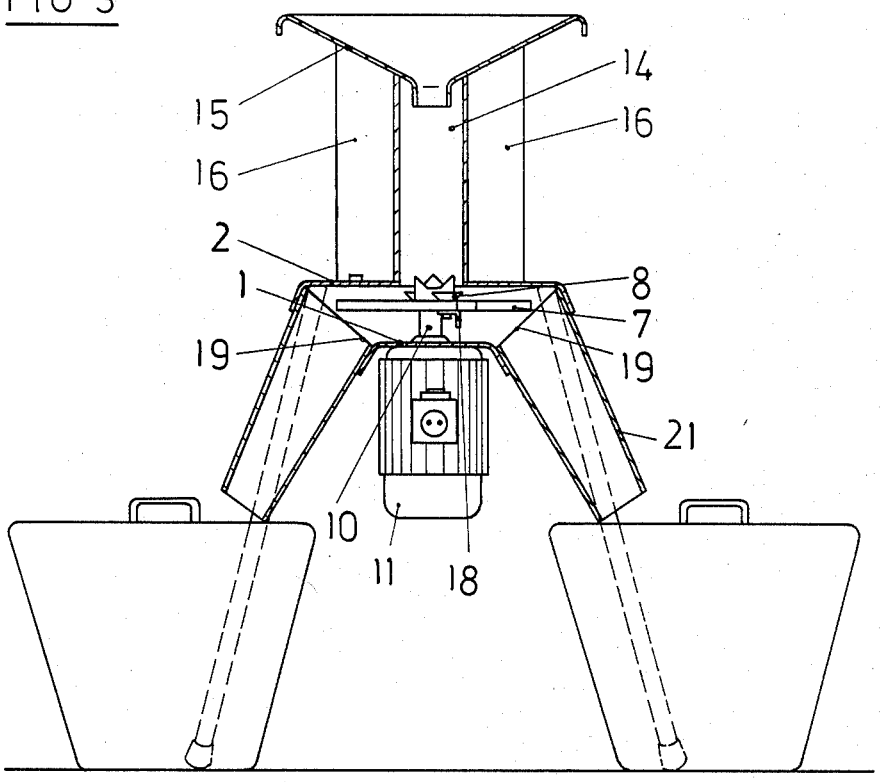
FIG. 3 is a longitudinal section taken through a second working example of the novel waste chopper with two ejection openings and two knives.
Figure 4:
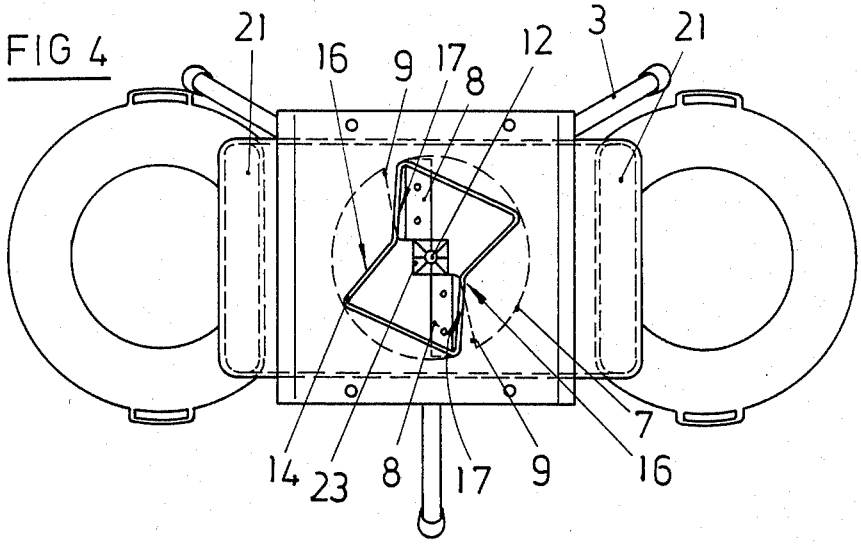
FIG. 4 is a plan view of the arrangement of FIG. 3 after removal of its hopper.

Generally the structure of the arrangement of FIGS. 3 and 4 is identical to that of FIGS. 1 and 2. Accordingly the same reference numerals are used for like parts. The design of FIGS. 3 and 4 differs from that of FIGS. 1 and 2 inasfar as the charging passage 14 has two diametrally opposite inward protrusions 16 and the housing 2 has diametrally opposite ejection openings 19 associated with the inward protrusions 16 and furthermore the carrier disk 7 is armed with two diametrally opposite knives 8.

The chopper shown in FIGS. 3 and 4 also has a housing made up of a floor 1 and a cover 2 flange-mounted thereon, the housing defining a chamber 6 for a carrier disk 7 mounted on a shaft 10 of a motor 11 attached to the floor 1. The carrier disk 7 is provided with a centrally placed, spur-bearing deflector member 23 of the type shown in FIG. 5 and so placed that opposite sides engage the inner ends of the two oppositely placed knives 8, same each extending over a respective slot 9. The carrier disk 7 accordingly also has two slots 9. The knives 8 may be arranged precisely radially but in the working example illustrated the two knives 8 are offset to a small degree in relation to a diametral line forward in the direction of rotation of the carrier disk 7. The same thus applies for the edges of the slots 9, this being an advantage as regards the strength of the carrier disk 7.

The charging passage 14 in this case has a polygonal cross section with the two inward protrusions 16 and is so mounted on the cover 2 that its upright axis coincides with the axis of the carrier disk 7. The charging passage 14 with a polygonal cross section may be made up of two pressings with a W-like configuration. The minimum clearance width of the polygonal cross section charging passage 14 is in this case approximately equal to the maximum diameter of the deflector member 23 mounted on the carrier disk 7. This diameter is so selected that the clearance width of the charging passage 14 even adjacent to the inward protrusions 16 is large enough to preclude stoppages. The length of the knives 8 and the stationary support bolsters associated therewith adjacent to the inward protrusions 16 is somewhat shorter than with the design only having one knife. The same also applies for the slots 9, this being an advantage as regards the strength of the carrier disk 7. At the same time this is an advantage from the point of view of the power requirement and thus of the size of the motor.

Each inward protrusion 16, whose rear edge forms a stationary support bolster 17 cooperating with the rotating knives 8, is provided with an ejection opening 19, which is formed by a recess, defining an opening area which is inclined downwards, in the edge of the trough-like floor 1. In this case as well, as may be seen from FIG. 4, the arrangement may be so designed that, as seen in plan view, a perpendicular drawn to the plane of the opening of the ejection opening 19 is perpendicular to the side, forming the respective support bolster, of the adjacent inward protrusion 16. Just as in the embodiment shown in FIGS. 1 and 2 a downwardly inclined ejection passage is mounted on each ejection opening 19. The presence of more than one ejection opening 19 leads to an increase in the overall ejection area, this not being without a favorable effect on the avoidance of stoppages in the ejection system.

What is claimed is:

1. A device for chopping material, comprising:

a housing including at least one ejector opening, said housing defining a chamber and having a floor which defines part of said chamber;

a plurality of support legs to which the housing is mounted;

a motor mounted to the floor of said housing, said motor having an output shaft which extends into said chamber;

a carrier disk mounted in said chamber to said output shaft to rotate in said chamber, said carrier disk having a deflector mounted at its center and at least one slot formed therein, each slot defining a trailing edge;

means mounted to the housing and defining a charging passage arranged over and extending upward from said carrier disk, said carrier disk shutting off the charging passage at one end thereof, said charging passage defining means having at least one inward protrusion, extending transversely in relation to the direction of rotation of said carrier disk, defining thereby a stationary support bolster for supporting the material being chopped; and at least one knife mounted to the carrier disk and extending in a generally radial direction, each knife having an edge aligned with the trailing edge of an associated slot, wherein the number of ejector openings is equal to the number of stationary support bolsters, and an axis extending perpendicularly from the area of each ejector opening is generally perpendicular to the surface defining its respective stationary support bolsters.

2. The chopping device as claimed in claim 1 wherein said charging passage is located so that its axis is upright.

3. The chopping device as claimed in claim 1 wherein said charging passage has a constant cross section along the full length thereof.

4. The chopping device as claimed in claim 1, further comprising a downwardly converging hopper mounted on top of the means defining the charging passage.

5. The chopping device as claimed in claim 1, further wherein the at least one inward protrusion of said means defining the charging passage has a side, forming such stationary support bolster, set in relation to a radial line perpendicular to the axis of ejection so that its radially outer end is inclined against the direction of rotation while its inner radial end is inclined in the direction of rotation.

6. The chopping device as claimed in claim 1 wherein the at least one inward protrusion of the charging passage has a side, forming such stationary support bolster, set in relation to a radial line perpendicular to the axis of ejection so that its radially outer end is inclined against the direction of rotation while its outer radial end is inclined in the direction of rotation.

7. The chopping device as claimed in claim 1, further wherein said means defining the charging passage has a single inward protrusion, the charging passage having a cross section corresponding to a segment of a circle concentric to the axis of the carrier disk and to a chord bent radially inwards at a point halfway between its ends.

8. The chopping device as claimed in claim 1, further wherein the means defining the charging passage has a polygonal cross section centered on an axis defined by the disk with at least one inward protrusion.

9. The chopping device as claimed in claim 8, further wherein said means defining the charging passage has at least two such inward protrusions at 180° corresponding number of ejection openings.

10. The chopping device as claimed in claim 1 wherein said at least one knife is so arranged that an inner radial end thereof adjoins said deflector member.

11. The chopping device as claimed in claim 1 wherein said deflector member has a maximum diameter equal to twice the distance between a radially inner end of said at least one inward protrusion and the axis of the carrier disk.

12. The chopping device as claimed in claim 1 wherein said deflector member is formed with at least one spur projecting into said charging passage and with a central hole for attachment thereof to said motor by screw means.

13. The chopping device as claimed in claim 1 wherein said deflecting member is in the form of a shape with a number of spurs thereon in a castellated configuration.

14. The chopping device as claimed in claim one 1, further wherein one such knife is provided placed radially in relation to said carrier disk.

15. The chopping device as claimed in claim 1, further wherein two such knives are provided that are generally aligned with a diametral line in such a way that they are each offset in a rotationally forward direction from said line while being parallel to said line.

16. The chopping device as claimed in claim comprising 1, further one means defining obliquely downwardly sloping ejection passage associated with said at least one ejection opening.

17. The chopping device as claimed in claim 16, further wherein said at least one ejection opening is set so that the plane defined by said ejection opening is downwardly inclined.

18. The chopping device as claimed in claim 16, further wherein the floor of said housing is shell-like, said housing further including a flat cover carrying said means defining the charging passage, both said floor and said flat cover having flanges for attachment of said means defining the ejection passage.

19. The chopping device as claimed in claim 1, further wherein said housing has two parts with a a flange thereon joining the two parts thereof together, said leg being joined to said flange

* * * * *